United States Patent [19]

Nichols et al.

[11] Patent Number: 4,759,661

[45] Date of Patent: Jul. 26, 1988

[54] LEACHING SYSTEM CONDUIT

[75] Inventors: James M. Nichols, Old Saybrook; Randall C. May, Mansfield Center, both of Conn.

[73] Assignee: Infiltrator Systems Inc, Old Saybrook, Conn.

[21] Appl. No.: 19,741

[22] Filed: Feb. 27, 1987

[51] Int. Cl.[4] ..... E02B 13/00

[52] U.S. Cl. ..... 405/48; 405/43; 405/46; 405/49; 138/105

[58] Field of Search ..... 405/36, 43, 44, 45, 405/46, 47, 48, 49, 51; 138/105, 121, 155, 173; 210/170

[56] References Cited

U.S. PATENT DOCUMENTS

| | | | |
|---|---|---|---|
| 460,352 | 9/1891 | Reading | 405/48 |
| 680,548 | 8/1901 | Sikes | 405/46 |
| 2,366,522 | 1/1945 | Gutman | 405/46 |
| 2,866,319 | 12/1958 | Nicholson | 405/46 |
| 3,333,422 | 8/1967 | Neyland | 405/48 |
| 3,440,823 | 4/1969 | Olsen | 405/43 |
| 3,495,410 | 2/1970 | Bailey et al. | 405/46 |
| 3,570,251 | 3/1971 | Roberts | 405/46 |
| 3,579,995 | 5/1971 | Flynn | 405/46 |
| 3,645,100 | 2/1972 | La Monica | 405/46 |
| 4,183,696 | 1/1980 | Auriemma | 405/43 |
| 4,245,924 | 1/1981 | Fouss et al. | 405/49 X |
| 4,523,613 | 6/1985 | Fouss et al. | 138/121 |

OTHER PUBLICATIONS

"Gravelless Pipe", Product Brochure, Hancor Inc., Findlay, Ohio (1985).

*Primary Examiner*—Randolph A. Reese
*Assistant Examiner*—John A. Ricci
*Attorney, Agent, or Firm*—C. G. Nessler

[57] ABSTRACT

A thermoplastic device for leaching sewage system effluent into the earth has the shape of an inverted trough. Its sidewalls have slot shaped perforations; above each slot is a lip; beneath each slot is one or more protuberances, preferably rectanguloid in shape. The combination of lips and protuberances prevent compaction of the earth against the sidewalls when the devices are buried without the use of stone fill. They permit the formation of a good biocrust layer and facilitate the exfiltration of liquid into the earth.

17 Claims, 3 Drawing Sheets

LEACHING SYSTEM CONDUIT

TECHNICAL FIELD

The present invention relates to the dispersion or collection of liquids within the earth, most particularly to the dispersion of liquids from subsurface sewage disposal systems.

BACKGROUND

The present invention is principally useful in on-site sewage disposal systems which are comprised of septic tanks and leaching fields. The invention is an improvement to the leaching systems which have heretofore been known.

Generally, sewage is digested in a vessel commonly called a septic tank and liquid is discharged therefrom to be dispersed and renovated by bacterial action and oxidation beneath the surface of the earth. Such dispersions may be accomplished in a variety of ways, but most commonly the effluent is run through perforated piping placed within stone filled leaching trenches dug within the native earth material.

Typically, a trench is partially filled with stone, a perforated pipe is laid therein, additional stone is added, the stone is covered with a semi-permeable membrane such as building paper or salt hay, and the membrane is covered with earth. A common alternative method is to place large pre-cast concrete structures, called galleries, within larger trenches with and without the use of surrounding stone. Galleries operate in analogous fashion to the pipe system but they typically have larger volume to surface area ratios.

The stone in the leaching trenches serves the purposes of supporting the distribution pipe and the sides and top of the soil cavity. The effluent discharge surface area is commonly considered to be the area of the sides and bottom of the stone-soil interface. The pore volume within the stone mass, commonly about one third of the bulk volume of one inch nominal diameter stone, provides storage capacity for surges in liquid flow. The pore volume also establishes the effective area at the soil-stone interface.

However, there are problems associated with the use of stone. These include that it is often costly to obtain in requisite quality, is labor intensive to install, and tends to be installed by heavy equipment in a way which compacts and decreases the permeability of the soil. Since stone occupies about two-thirds of the earth-cavity volume, it thereby substantially limits the desired liquid storage volume. And, over time the stone can be infiltrated by and filled with fine soil, thus degrading both its storage capacity and the effluent dispersal surface area which was originally contemplated.

Thus, there have been developed and are used certain "no-stone" leaching systems. But these devices have limitations which the present invention is intended to overcome. Principal among the no-stone systems are the previously mentioned galleries, or precast concrete leaching chambers, such as shown in U.S. Pat. No. 3,645,100 of LaMonica. Typically, such chambers may measure 4 by 8 by 1.5 feet in dimension. Not only are such units costly but they require large earth openings and heavy equipment to install. Furthermore, the typical discharge area achievable in precast concrete units tends to be about 8 percent of the chamber sidewall, and thus they can only be used without stone in certain suitable soils. There is also marketed a perforated pipe of relatively large (8–10 inch) diameter having a filter fabric on the exterior. Fine filter media risks the propensity for clogging over time and damage during installation.

Thus, common problems with prior art no-stone systems are both the limited discharge area into the earth and blockage of the effluent holes.

Various patents show considerable past effort on alternatives for dispersing or collecting liquids in the earth and some have bearing on the present invention. U.S. Pat. No. 460,352 to Reading shows a perforated drain tile with lips over the perforations in the pipe sidewall. Auriemma U.S. Pat. No. 4,183,696 shows a plastic drainage pipe having triangular shaped openings with a protective lip over the openings.

Gutman in U.S. Pat. No. 2,366,522 shows an arch shaped leaching unit for burying in the earth, but the effluent can only flow vertically downward. See also Nicholson U.S. Pat. No. 2,866,319 and Olsen U.S. Pat. No. 3,440,823 where there are small exit holes at the bottom of the arch. Flynn in U.S. Pat. No. 3,579,995 shows an rectanguloid cross section open-bottomed concrete unit with holes in the sidewalls. A series of different extension lips over each horizontal row of holes is said to keep the sides of the earth trench stable and spaced apart from the buried walls of the unit.

However, of the various units mentioned above, only the pre-cast concrete galleries have met with both widespread commercial use and regulatory agency approval for septic tank leaching systems. Principally, this appears to be due to the failure of the other units to demonstrate requisite functionality and durability. Most probably, this is because with the passage of time the surrounding soil tends to move against the sidewalls and thus limit the efflux of liquid.

Thus, there remains a need for a leaching system which is light in weight and easily installed in a variety of soils, and which maintains its capacity for exfiltration over a period of time.

DISCLOSURE OF THE INVENTION

An object of the present invention is to provide a means for dispersing liquid beneath the surface of the earth. A more particular object of the invention is to provide a durable and easily installed leaching device, to eliminate the cost and difficulty of using stone, and to at the same time achieve the leaching characteristics of perforated pipe laid in stone filled trenches.

According to the invention, a leaching conduit has sidewalls along which are a series of perforations and associated projections above and below. Above each perforation is a lip which hinders infiltration of earth into the conduit. Below each perforation are one or more protuberances extending from the sidewall. The combination of lip and protuberance simulates the effect of stone; it prevents compaction of the earth vertically below the point where the features project from the sidewall. The sidewall design provides a desired high exfiltration area into the abutting earth and it enables the formation of a good biocrust.

In a preferred embodiment the device is an arch shaped inverted trough; the perforations are slots, and below each slot there are three-to-four rectanguloid protuberances. The slots slope downwardly, from the interior to the exterior to lessen infiltration of solids into the device. Vertical sidewall ribs divide the separate lip, slot and protuberance arrays, which the inventors call "Micro-Leaching Chambers". Preferably, the device is open-bottomed, made of plastic for light weight, and corrugated to increase strength. The corrugating is complex and the raised portions thereof are tapered as they run toward the top or apex of the arch, to enable nesting of the units for shipping.

In use, the units are laid end-to-end in a closely fitting trench, and native earth fill is placed over them. Shiplap joints are made between the abutting units and end closures are used at the end of a series of units. The interior of the arch cross section of the device provides effluent storage capacity while the shape of the exterior provides a favorable effluent discharge area without the use of stone.

The foregoing and other objects, features and advantages of the present invention will become more apparent from the following description of preferred embodiments and accompanying drawings.

BEST MODE FOR CARRYING OUT THE INVENTION

Figure 1:
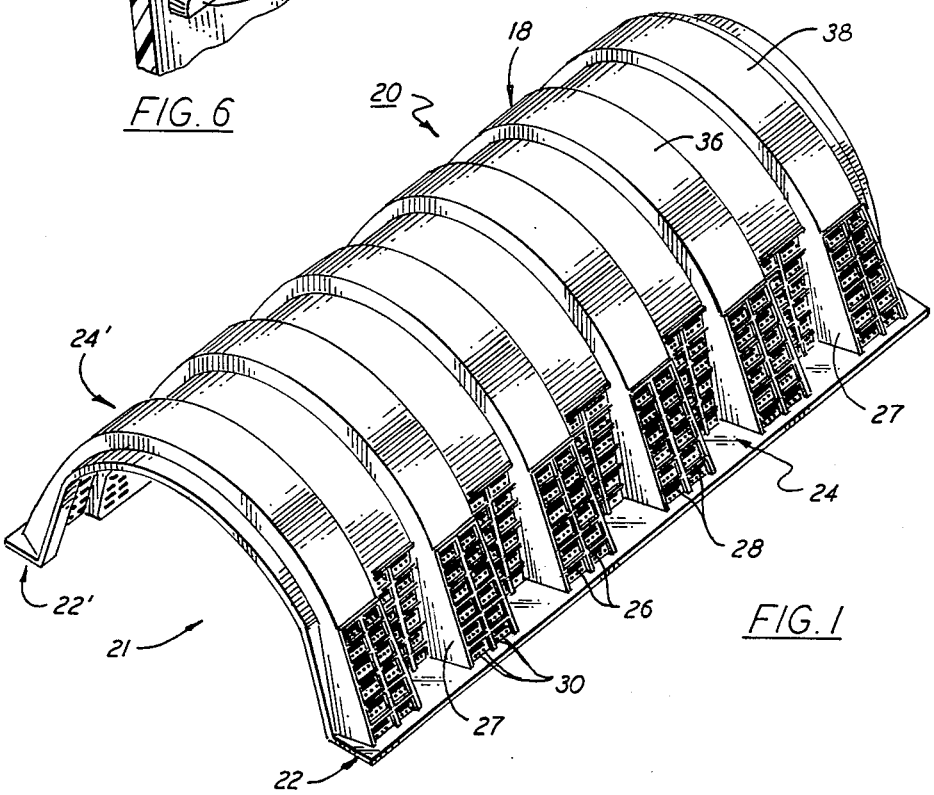
FIG. 1 shows an arch shaped embodiment of the present invention, in particular a polymer structure with many molded sidewall details.

The invention is described in terms of its preferred embodiments which are shown in the Figures. Preferably, the device is made of a polymer, such as molded high density polyethylene, although it will be evident that alternate materials may be used. The device 20 is in the shape of an inverted trough; that is, it is arch shaped in cross section and has a top 18 when put in its working position, as shown in FIG. 1. The device 20 preferably has an open base, and the bottom flanges 22, 22' of the sidewalls 24, 24' rest upon the earth. A multiplicity of slot shaped perforations 26 are in the sidewalls, and associated with these are lips 28 and spaced-apart rectanguloid protuberances 30. These are shown in more detail in the other figures which are further described below.

Figure 5:
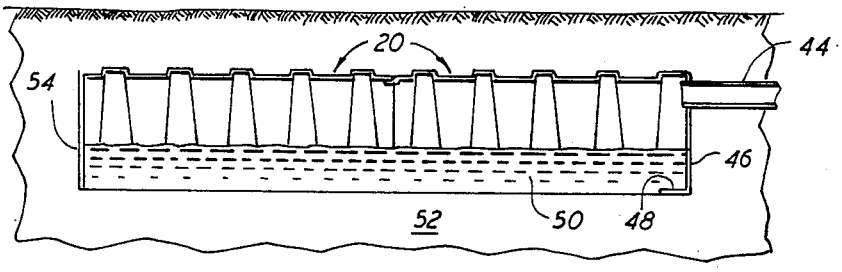
FIG. 5 shows an assembly of devices in functional place within the earth.

In use, a plurality of the devices 20 are buried within the earth 52, and adjacent sections are mated, as shown in FIG. 5. Sewage system effluent 50, as from a septic tank, flows into the open space within the arch, and along the lengths of the arch sections. That liquid which does not infiltrate through the open bottom and into the earth, rises within the ample surge volume of the arch shape until it reaches the level of a multiplicity of slot shaped passages which perforate the side walls. The fluid will then flow through the slots and into the earth surrounding the sidewalls. It is the particular combination of sidewall details of the present invention which make it superior in overcoming the problems described in the Background.

Figure 2:
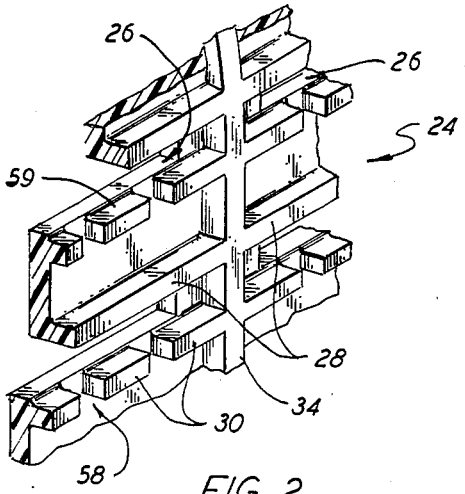
FIG. 2 shows a closer view of the details of the sidewall of the article shown in FIG. 1.
Figure 9:
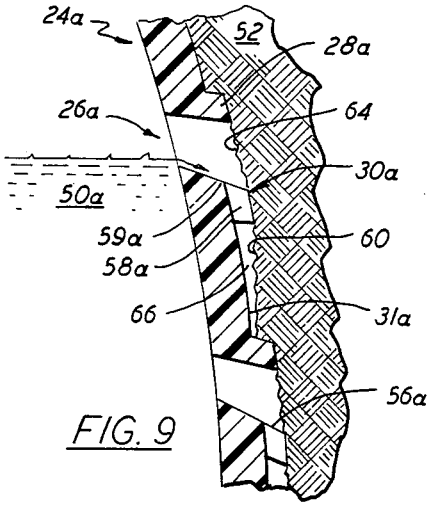
FIG. 9 shows conceptually how the lip and protuberances function within the earth when the invention is in use.

FIG. 2 shows in closer detail a part of the sidewall 24. Ihe lips 28 extend from the sidewall and below each is a horizontally extending slot 26. Each slot has associated with it one or more individual protuberances 30 having spaces 58 therebetween. The functioning of the lip, slot, and protuberance combination, which the inventors style as "Micro-Leaching Chamber" units is schematically illustrated by FIG. 9. Liquid 50*a* rises to the level of a slot 26*a* and flows through it as illustrated by the arrow. Earth 52 which surrounds the unit lies on the lip 28*a*; the projection of the lip keeps the surface 64 of the earth which has fallen vertically from the lip from entering the slot opening and also tends to keep the earth from filling the vertical space 58*a* between adjacent protuberances. Thus liquid is able to flow over and between the protuberances into the relatively uncompacted earth space 66 below each protuberance. The lip and protuberance shielding provides areas 60, 64 where conditions are especially suitable for the formation of a biocrust and good exfiltration of liquid into the earth.

Figure 3:
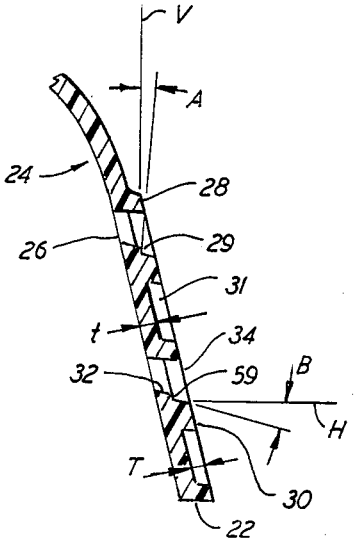
FIG. 3 shows a cross section through the sidewall of a device, to illustrate certain geometric features.
Figure 8:
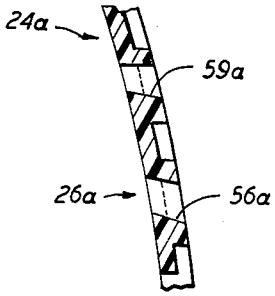
FIG. 8 shows the protuberance configuration in a preferred sidewall cross section.
Figure 7:
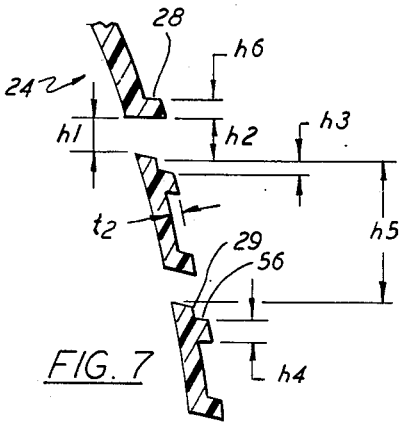
FIG. 7 shows sidewall cross section details, similar to FIG. 3.

There are certain preferred geometric relationships illustrated by the sidewall 24, 24*a* cross sections of FIG. 3, 7 and 8. In FIG. 3, the lip 28 extends at least to the vertical line V which extends upwardly from the point 29 where the slot bottom intersects the line 31 of the outer surface of the sidewall; preferably the lip extends to a line running from its edge to pcint 29, which line forms a slight angle A of 5+ degrees with the vertical V. The bottom 32 of the slot slopes downward at an angle B to the horizontal H as it passes through the wall thickness t, from the inside to the outside of the arch cross section. Preferably the angle B is about 20 degrees. The lip extension and the slope of the slot tend to prevent fine sand particles which may come vertically down due to action of rain and the like from infiltrating the interior of the device. In certain soils, lesser degrees of shielding may be adequate, but in most instances it is desirable to have the lips and protuberances extend transversely from the sidewall a distance t2 which is as great as possible. But this desire will be limited by cost of manufacture and the desire to allow nesting of the units, as discussed below.

Referring again to FIGS. 2, 3 and 9, it is also preferred that the lip 28, 28*a* extend sufficiently far from the sidewall so that the vertical projection of its outermost edge be farther from the sidewall than is the vertical projection of the intersection 59, 59*a* of the sidewall line 31, 31*a* with upper surface 56*a* of the protuberances 30, 30*a*. In this way, when the protuberances are spaced apart, earth will tend to be kept from tightly compacting in the space 58, 58*a* between adjacent protuberances; and, thus liquid flow to the region beneath the protuberances will be facilitated.

As shown in FIGS. 8 and 9, one of the preferred configurations has the protuberance upper surface 56, 56*a* being coextensive with the lower surface of the slot 26*a*. Most preferably, the protuberances should be located in close proximity to the perforation discharge point; preferably the distance h3 in FIG. 7, from the outer edge 29 of the opening to the top of the protuberance, should be between 0–1 times the slot opening height h1.

Figure 4:
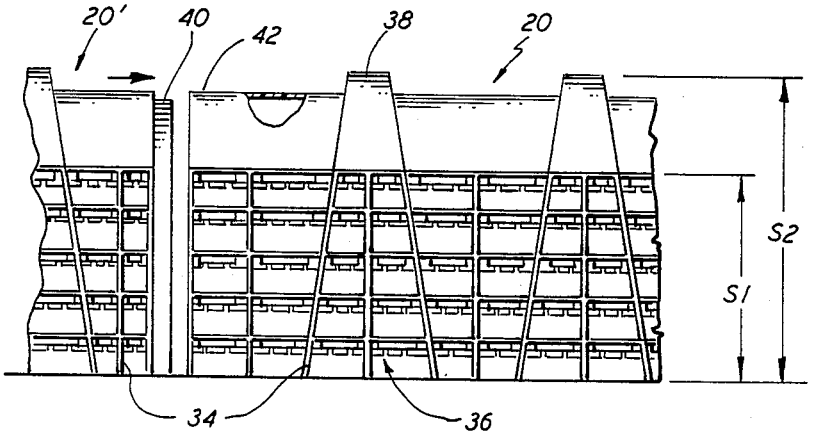
FIG. 4 shows a side view of the device shown in FIG. 1, together with a like unit, illustrating how the units join one another. Also shown is how the structural ribs are tapered.

FIGS. 2–4 also illustrate vertical subdividing ribs 34 which provide the dual function of locally increasing sidewall strength and of defining the separate Micro-Leaching Chamber units 36. The device can be made without such ribs in other embodiments.

FIGS. 1 and 4 show how the perforations and associated features do not extend all the way up the height S2 of the arch shape, but only to a distance S1. The top part of the arch curve is solid to prevent infiltration of fine earth into the unit due to such fine material being carried downward, as by the permeation of rainwater and the like FIGS. 1 and 4, as well as others, show that the unit is corrugated to increase the device's structural strength and resistance to the load applied by the earth and anything resting on it. As shown, the peaks and valleys of the corrugation have the Micro-Leaching Chambers at the sidewall locations. FIG. 4 shows how the corrugations peak sections 38 are tapered when viewed from the side. And FIG. 1 shows how the corrugation rise, from peak to valley, increases from the base 22 to the top or arch apex 18; an increasing width of web 27 toward the top results. Thus, each peak section 38 of the corrugation is narrower at the apex when measured along the length of the device and narrower at the base when measured perpendicular to the arch shape surface in the plane transverse to the length. This compound taper relationship, combined with the open bottom, enables good nesting of the devices for economical shipment, but maximizes the sidewall leaching area effectiveness and strength.

FIG. 4 also illustrates how the devices are made so that they conveniently adjoin each other when placed in the earth. FIG. 5 shows in cross section an assembly of devices laid end-to-end within the earth. A shiplap type joint is preferably used, wherein one end 40 of a device 20′ is made smaller than, but congruent with, the other end 42 of the abutting unit (and its own other end, not shown). As shown in FIG. 5, the one end of the device is preferably made to occur at a larger corrugation section, to enable the inlet pipe 44 to enter at a high elevation with respect to the base of the unit. It also may be preferred to mold into the top of the end corrugation an even more raised fitting, to receive the inlet pipe at even higher elevations.

Closures 46, 54 are ordinarily used at both ends of the assembly, to keep earth from infiltrating and to provide the means by which sewage effluent is delivered. As shown, a pipe 44 delivers the effluent to the unit. An inlet end closure 46 is preferably fitted with a splash baffle 48. A terminus end closure 54 stops earth from infiltrating the unit over time. With suitable design of the mating surfaces on the opposing sides of an end closure, the same closure can be adapted for use at both ends of an assembly. The various component parts of an assembly may be interlocked to one another, as by a male and female snap features, pinning, etc. Other means for joining the abutting devices can also be used.

During use, the liquid 50 flows into the unit and fills it, to the extent it does not infiltrate the earth 52 at the open bottom. As it rises, liquid flows out the slot shaped perforations and into the surrounding earth. It will be appreciated from the dimensions that are given below for an actual device that there is considerable volume within the device for surge or ponding of effluent. The device leaches at least as well as a conventional stone installation of comparable trench dimension, but because of the the hollowness of the interior it has considerably more storage volume.

The following is a description of the construction of a best mode embodiment like that shown in FIG. 1. The device is made of high density polyethylene, such as type T-600 of Soltex, Inc., Houston, Tex. USA. It is about 76 inch long by 34 inch wide at the base, suited for installing in a 36 inch wide trench. The height S2 to the arch top is about 15 inch; the micro-leaching chambers extend to a vertical sidewall height S1 of about 9.5 inch. The sidewall angles are nominally 18–19 degrees.

There are six raised corrugated portions along the length of the device, each one is about 4.2 inch wide at the top and about 9 inch wide at the base; the valleys therebetween have approximately inverse dimensions, The peaks extend about 2 inch laterally from the sidewall at the base, and about 2.5 inch from the apex 18 of the device. The interior curve of the arch top has a radius of about 24 inch, while the top curve of the ribs is about 19.5 inch radius.

The material thickness t is about 0.25 inch; the subdividing rib height T is about 0.25 inch; the lip thickness h6 is about 0.25 inch; its extension t2 (and that of the protuberance as well) is about 0.25 inch; and, it has an angle A of about 25 degrees from the vertical. The vertical pitch h5 between the lips (or each Micro-Leaching Chamber unit) is about 1.5 inch. The angle B of the bottom of the slot is about 20 degrees. The slots inlet end opening h1 is about 0.25 inch while the discharge opening h2 is about 0.35 inch. The slot length ranges from 1.7 to 2.8 inch, depending on where the slot is vertically and laterally on the sidewall.

The protuberances are rectanguloid, having a vertical thickness h4 of about 0.25 inch; there are four under a typical slot, and each is about 0.18 to 0.8 inch length (again, as with the slot length, depending on location on the sidewall), and the spaces between each protuberance are about 0.25 inch.

The 6 rows of slots provide about 23 percent opening area in the S1 part of the sidewall. The summation of the areas 60, 64 where biocrust can form and exfiltration can readily take place (as described for FIG. 9) is calculated to be about 85+ percent of the S1 part of the sidewall, indicating dramatically the device's effectiveness. When the area of the bottom of the conduit is also considered with the sidewall area just mentioned, the particular unit described here provides a total exfiltration surface area of over 4 sq ft per ft of length.

The essential invention can be made in various embodiments beyond those just described. In particular, the perforations are preferably slot like for maximum area, but a line of small holes can be substituted for the slot. The openings, whether slot shaped or otherwise, should be sufficiently large to not become plugged over time by minor effluent borne accretions, but sufficiently small so that larger matter cannot work its way backward through them over great time. Slots 0.25–0.35 inch wide by 1–6 inch length are preferred.

Figure 6:
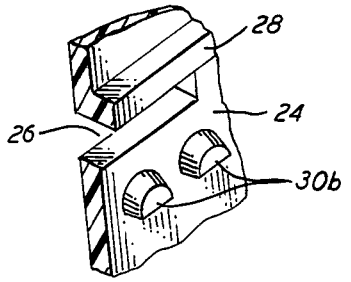
FIG. 6 is a detail of the sidewall to illustrate alternative kinds of protuberances.
Figure 10:
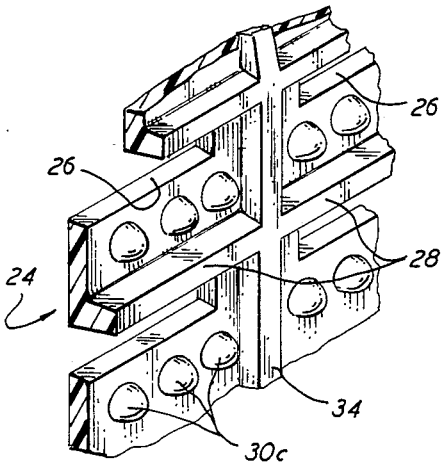
FIG. 10 shows an alternative semi-spherical protuberance configuration.

The protuberances can be of various shapes while carrying out the essential function of preventing compaction beneath the slot. The protuberances are preferably of the rectanguloid shape shown in the Figures just referred to. As such, the shape tends to maximize the effectiveness of the protuberance in limiting the compaction of soil beneath it. However, other section shapes can be employed, as such section shapes are viewed both from the side view, e.g. FIG. 4, and the cross section view, e.g. FIG. 2. Illustrative of such are the semi-cylindrical protuberances 30*b* shown in FIG. 6 and the semi-spherical protuberances 30*c* shown in FIG. 10.

Figure 11:
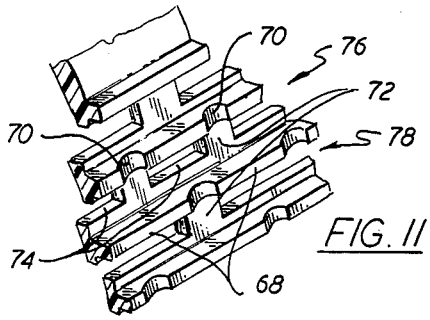
FIG. 11 shows a sidewall fragment where the protuberances below a slot serve also as the lip above the next lower slot.

Another variation of the invention, shown in FIG. 11, is to have the protuberances 68 beneath a row 76 of openings 74 simultaneously perform as a segmented lip above the next lower row 78 of openings. Note how there is a staggered array so that lip/protuberance spaces 70 are directly above the wall sections 72 between slots in the row 78 below, to avoid infiltration where the lip shielding function is discontinuous. This combined lip/protuberance design is less preferred because of weakening of the side-wall when the slots are too close together vertically.

Spaced apart protuberances are preferred for letting the liquid more easily infiltrate vertically downward. But other variations in the protuberance will become apparent which will accomplish the same result. For example, as suggested by the FIG. 11 drawing, the t2 extension of the protuberance can vary along its length, much as a saw tooth.

The curved arch shown herein is preferred, but within the scope of the invention, there can be used other cross section shapes, ihcluding trapezoidal, rectanguloild, and the like, and the term "arch" is meant to embrace them. Cross ties and interior members within an inverted trough section may be employed for enhanced structural strength. Furthermore, the principles of the essential invention can be applied to other conduits carrying out similar function. Thus, the principles of the invention will be usable on closed-bottomed arch shape devices as well; and, within the scope of the claims herein, a pipe or round conduit may be considered a trough or arch shaped device having a closed curved bottom.

While thermoplastic material is preferred for light weight and durability, units may be made out of ceramics and metals. While the invention has been described in terms of its principal intended function, disposing of sewage, it is within contemplation that the features of the device will also make it usable for collecting liquid from the earth, and thus the adaptation which is principally described here is not intended to be limiting.

Although the invention has been shown and described with respect to the preferred embodiment and some alternatives, it will be understood by those skilled in the art that various further changes in form and detail thereof may be made without departing from the spirit and scope of the claimed invention.

We claim:

1. A device for dispersing liquids within the earth, having the shape of an inverted trough; being arch shape in cross section, with the top of the device during use being at the top of the arch, and the base of the device during use being at the base end of the arch; having sidewalls with a multiplicity of perforations for the passage of liquids, characterized by perforations having lips vertically thereabove to shield the openings, and spaced apart protuberances therebelow to aid dispersion of liquids in the earth.

2. The device of claim 1 characterized by slot shaped perforations running lengthwise along the length of the sidewall of the device.

3. The device of claim 2 characterized by the slot area being at least 20 percent of the sidewall area where slots are present.

4. The device of claim 1 characterized by perforations which slope downwardly with respect to the top of the device, along the length of their passage through the thickness of the sidewall from the interior to the exterior of the arch cross section.

5. The device of claim 1 characterized by vertical subdivision ribs between adjacent perforation, lip and protuberance combinations.

6. The device of claim 1 characterized by a curved arch cross section shape, an open bottom, and open ends.

7. The device of claim 6 having one end with a cross section step portion which is adapted to bit into an end of an adjacent device, to enable identical devices laid end to end to shiplap each other.

8. The device of claim 1 characterized by protruberances which are rectanguloid.

9. The device of claim 1 characterized by each perforation having at least two spaced apart protuberances therebelow.

10. The device of claim 1 characterized by a corrugated trough shape, wherein alternating raised peak sections and valley sections run along the arch shape and transverse to the length of the device.

11. The device of claim 10 characterized by peak sections and, valleys having compound tapers, wherein each peak section is narrower at the top of the arch shape than at the base thereof, as narrowness is measured along the length of the device; and wherein each peak section rises from the valley adjacent thereto less at the base than at the top of the arch shape, as rise is measured perpendicular to the arch shape surface in the plane transverse to the length of the device, to enable one device to closely nest inside another and thereby facilitate the transport of a plurality of devices.

12. The device of claim 1 characterized by a lip having an outermost edge extending transversely from the sidewall to a point beyond the vertical geometric projection line from the outermost part of the perforation located proximately therebelow.

13. The device of claim 12 characterized by the outermost edge extending to a point beyond the vertical geometric projection line from the outermost part of a protuberance located just below the performation.

14. The device of claim 1 having two or more rows of performations, one above the other in staggered fashion, characterized by the protuberances below one of the rows simultaneously serving as the lips of the perforations of the next row therebelow.

15. The device of claim 1 characterized by a row of perforations with a continuous lip thereabove.

16. A conduit for dispersing liquids within the earth, having a sidewall with a multiplicity of perforations for the passage of liquids from the interior to the exterior thereof, characterized by perforations having both a lip protruding from the sidewall thereabove, to hinder infiltration of earth into the interior during use, and spaced apart protuberances therebelow, to hinder compaction of the earth below the protuberances.

17. The device of claim 16 characterized by the perforations being slots, each slot having at least two spaced apart protuberances therebelow.

* * * * *